US006394938B1

(12) United States Patent
Tornabene

(10) Patent No.: US 6,394,938 B1
(45) Date of Patent: May 28, 2002

(54) EXERCISE APPARATUS

(76) Inventor: Dean Tornabene, 4015 Glenco Ave. Unit No. 8, Marina Del Rey, CA (US) 90292

( * ) Notice: Subject to any disclaimer, the term of this patent is extended or adjusted under 35 U.S.C. 154(b) by 0 days.

(21) Appl. No.: 09/603,986

(22) Filed: Jun. 26, 2000

(51) Int. Cl.[7] ..... A63B 26/00

(52) U.S. Cl. ..... 482/142; 482/72; 482/129; 482/130

(58) Field of Search ..... 482/142, 72, 121–130

(56) References Cited

U.S. PATENT DOCUMENTS 5,350,346 A * 9/1994 Martinez ..... 482/142
5,871,425 A * 2/1999 Gvoich ..... 482/140
6,283,900 B1 * 9/2001 Tornabene ..... 482/122

* cited by examiner

*Primary Examiner*—Jerome W. Donnelly
*Assistant Examiner*—Lori Baker Amerson
(74) *Attorney, Agent, or Firm*—Howard A. Kenyon

(57) ABSTRACT

An exercise apparatus that exercises at least four groups of muscles is disclosed. The exercise apparatus exercises at least the calf muscles, the hamstring muscles, the quadriceps muscles and the maximus gluteus muscle. The apparatus utilizes a seated position and incorporates an elastomeric tension member to provide the resistance. The exercise apparatus incorporates a backrest and a footrest. When a person exercising pushes against the backrest, the backrest rotates listing the person exercising such that the four muscle groups are exercised.

1 Claim, 2 Drawing Sheets

EXERCISE APPARATUS

BACKGROUND OF THE INVENTION

1. Field of the Invention

This invention relates to an exercise apparatus and more particularly the present invention is directed to an exercise apparatus that will exercise at least four groups of muscles.

2. Description of the Prior Art

Many devices exist for exercising various parts of the body for commercial and home use. Some of the prior art devices are:

U.S. Pat. No. 5,575,741, to Robert Fan.

This exercise apparatus simulates horse riding type and rowing type exercise.

U.S. Pat. No. 4,526,013 to W. R. Dofel.

This exercise devise provides a mechanical resistance assembly which employs a resistance strap which is stretched by use of a pulley system pulled by the user.

U.S. Pat. No. 5,094,450 to Steams.

This exercise machine provides for abdominal exercising. This machine also allows a chest pod to rotate, which is resisted by either a viscous fluid resistance, or stacked weights.

U.S. Pat. No. 5,112,287 to Brewer.

This exercise apparatus employs a resistance that is experienced by a person exerting a force to pull or push the body engaging members. The resistance can be varied.

U.S. Pat. No. 4,809,976 to Isac Berger.

This apparatus utilizes a footrest tied into springs. Each limb can be independently exercised.

U.S. Pat. No. 4,619,144 to Gibson.

This devise is potable which performs upper and lower body exercises and also having a freestanding frame for storage.

SUMMARY OF THE INVENTION

It is the object of the present invention to provide an exercise apparatus to exercise four groups of muscles.

It is another object of the present invention to exercise the maximus gluteus muscle in addition to three leg muscles.

It is yet another object of the present invention that can be efficiently and economically manufactured.

Briefly, in accordance with the present invention there is provided an exercise apparatus that has a rectangular seat, which is attached on the bottom to a main hollow rectangular member. The main hollow rectangular member has two members attached to the main hollow rectangular member and extending backward at an angle of approximately 45 degrees. A footrest member extending forward from the seat is adjustable to account for the different lengths of exerciser's legs. The footrest member has a footrest that is pivoted and is also adjustable. A backrest has at the top an adjustable headrest. Attached to the backrest is a semi-circular member that rides in a track extending backward from the main hollow rectangular member. The semi-circular member contains an adjustable elastomeric band. The tensioning mechanism is controlled by a cable through pulleys. When the exerciser pushes back on the backrest, with the feet pushing against the footrest, the backrest will roll in a track and the exerciser's back will rotate, the exerciser's rear will lift off of the seat and simultaneously the tensioning will increase the tension force required to push backwards. The exerciser then relaxes the push backward and the semi-circular member will roll forward, the exerciser's rear will then engage the seat with the tensioning force decreasing. This movement is repeated until a complete workout is obtained in the previously mentioned four muscle groups.

These and other objects, features and advantages of the present invention will become more readily apparent upon detail consideration of the following Description of the Preferred Embodiment with reference to the accompanying drawings.

DESCRIPTION OF THE DRAWINGS

In the drawings that illustrate the best mode presently contemplated for carrying out the present invention are.

The novel features which are believe to be characteristic of the invention, both as its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF THE PREFERRED EMBODIMENT

Figure 1:
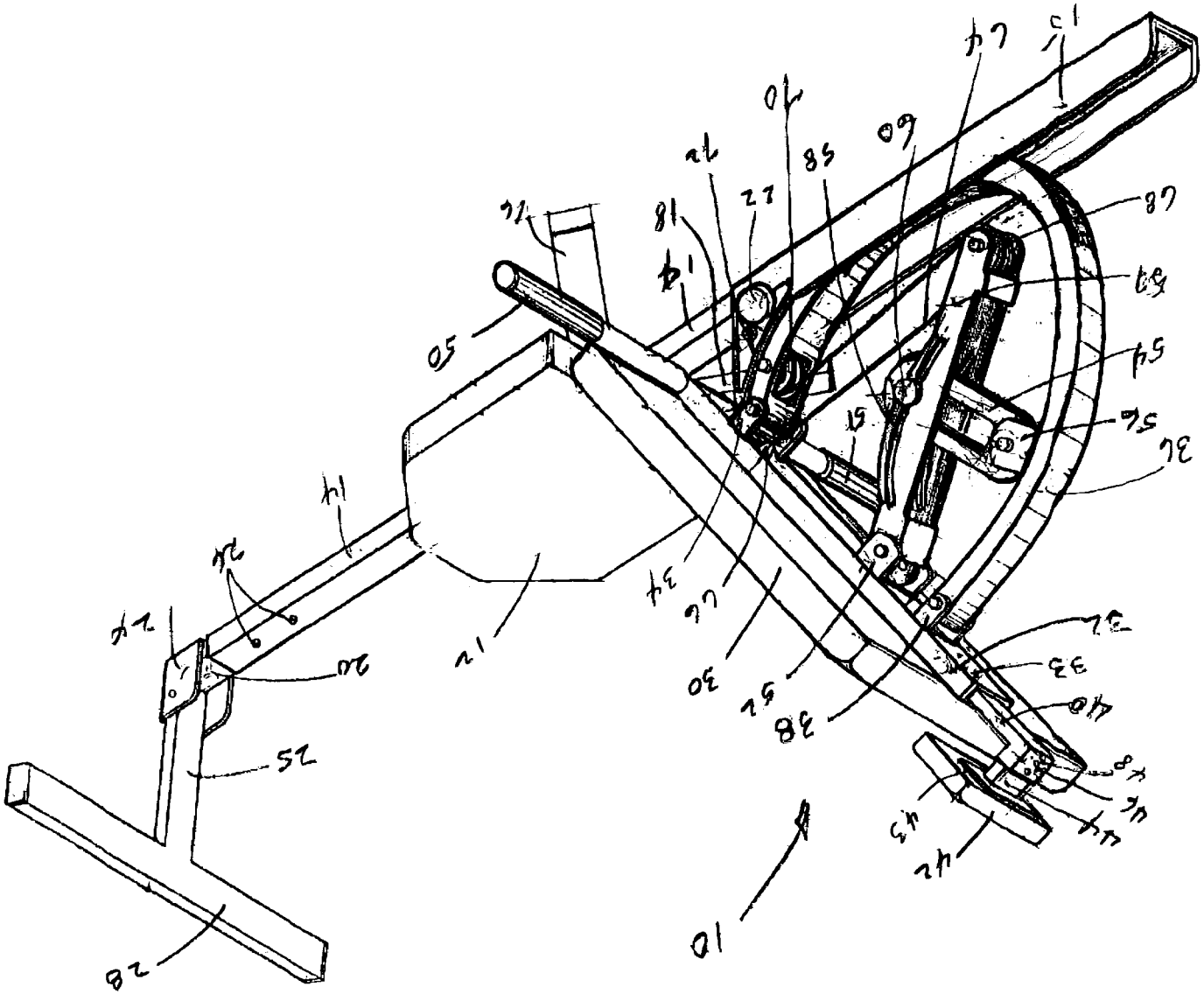
FIG. 1 is an isometric view of the present invention.
Figures 2, 3:
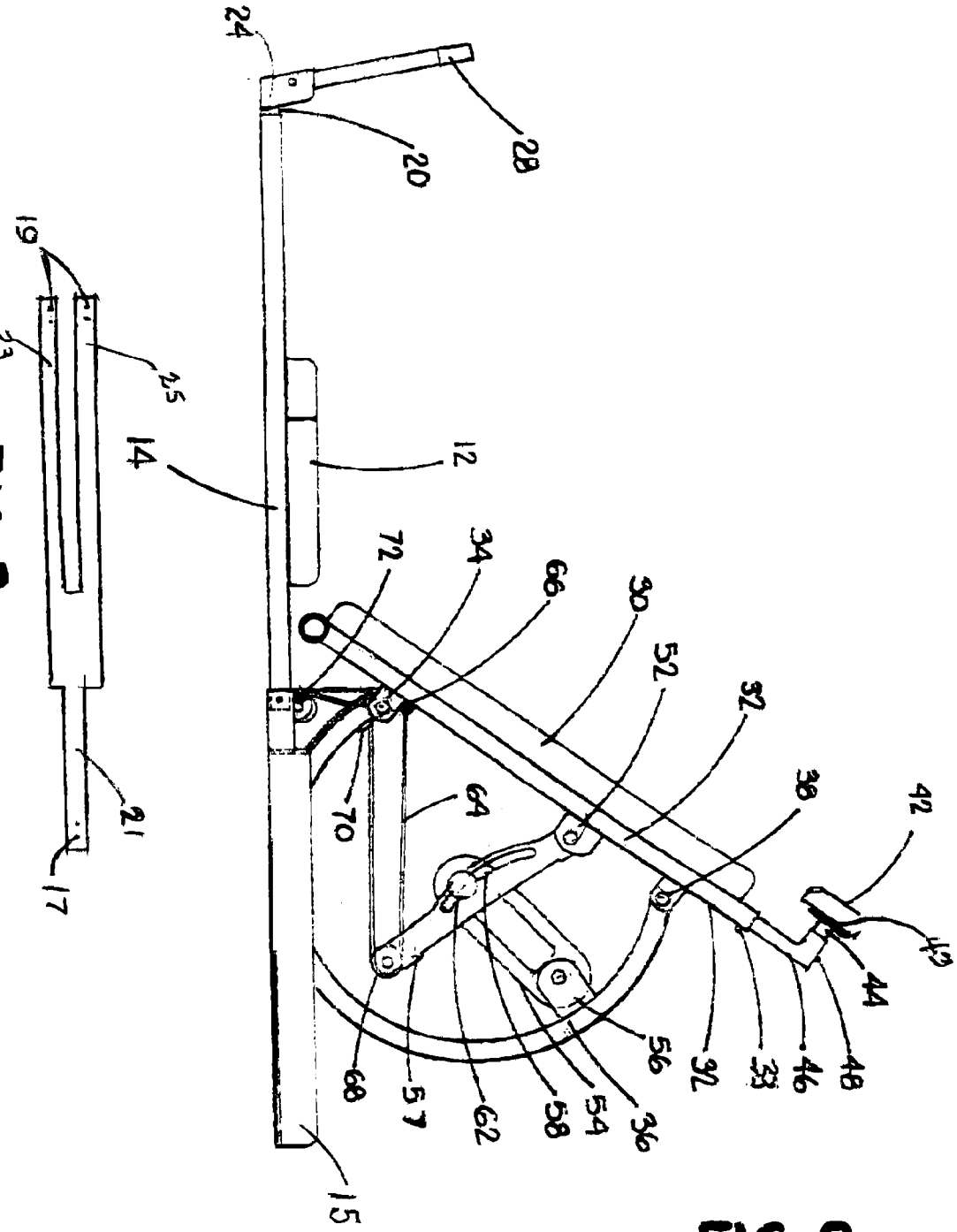
FIG. 2 is a left side view of the present invention.
FIG. 3 shows a plan view of the fiberglass strips that hold the circular channel member in the flat channel member.

Turning now to FIG. 1 there is seen a perspective view of the present invention generally shown as 10. This view shows the seat 12 that consists of a hard material covered by a foam rubber and is further covered by a waterproof material. Fastened to the seat is a main hollow rectangular member 14. Attached to the main hollow rectangular member 14 is a pair of rectangular members 16 and 18 which are extended rearward at approximately 45 degrees and which are used for stabilization. Extending forward and fitting inside the main hollow rectangular member 14 is a footrest member 20. The main hollow rectangular member 14 has a longitudinal adjustment by using a screw (not shown) where a knob 22 is attached to the upper end of the screw. The screw is threaded into a flat channel member 15 and is turned by the knob 22. When the proper adjustment is obtained by the exerciser using the knob 22, the screw is tightened and the screw bears on the main hollow rectangular member 14 holding the main hollow rectangular member 14 in place. The footrest member 20 has on the end a footrest bracket 24. The footrest bracket 24 has a footrest rectangular member 25 attached to the footrest bracket 24. The footrest member 20 is therefore adjustable by means of spring biased pins 26 extending through holes in the main hollow rectangular member 14. The footrest rectangular member 25 has a footrest 28 that is pivotally mounted in the footrest bracket 24. It is also noted that footrest 28 has a stop build in the bracket 24 that allows the footrest 28 to stop approximately 90 degrees to the footrest member 20. The footrest 28 pivots backward for storage of the exercise apparatus. Thus it can be seen that the exerciser can adjust for leg length by the screw attached to the knob 22 where the main hollow rectangular member 14 can slide into the flat channel member 15. Also, the exercise can adjust for leg length by the spring biased pins 26 when the rectangular member 20 attached to bracket 24 slides into the main hollow rectangular member 14. FIG. 1 also shows the backrest 30. Backrest 30 consists of a hard material covered by foam rubber (not shown) and is further covered by waterproof material. The backrest 30 is fastened to a rectangular hollow backrest member 32 by suitable fastening means such as screws. The backrest member 32 is in the center of the backer 30 and is fastened at the bottom by backrest 34 to a semi-circular channel member 36 and the rectangular hollow backrest member 32 is fastened at the top by bracket 38 also to the semicircular member 36. The rectangular hollow backrest member 32 extends upward where a headrest member 40 extends down in the rectangular hollow backrest member 32. The headrest 42 is adjustable upward and downward by spring biased pins 33 through a hole in the rectangular hollow backrest member 32. This is best seen in FIG. 2. The headrest 42 consists of a hard material covered by a foam rubber and is further covered by a waterproof material. The headrest 42 is fastened to a rectangular plate 43 by suitable means such as screws. Rectangular plate 43 is attached to rectangular member 44. Rectangular member 44 is fitted into a hollow rectangular member 46. Member 46 is attached to the upper end of headrest member 40. Member 44 is adjustable by spring biased pins 48 fitted into holes into member 46. Thus, the headrest is adjustable up or down and is also adjustable forward and backward. These adjustments are necessary to accommodate the difference in an exerciser's torso. Also seen in FIG. 1 are right and left hand grips 50 and 51 attached to the bottom or rectangular hollow backrest member 32 that stabilizes a person's body when performing the exercise with the present invention. Attached to the rectangular hollow backrest member 32 by pivoting means and by bracket 52 is a tensioning mechanism 57 which comprises a tension member 54 attached to the inside of circular member 36 by bracket 56. The tensioning member 54 is also attached to a tensioning bracket 56. The tensioning mechanism 57 has an arcuate slot 58 that pin 60 which holds one end of tensioning member 54 can slide. The opposite end of pin 60 is threaded and contains a knob 62 (seen in FIG. 2). When pin 60 containing tension member 54 is moved to the lower end of the arcuate slot 58, the tensioning member 54 provides maximum tension. Conversely, when pin 60 containing tension member 54 is moved to the upper end of the arcuate slot 58, the tension member 54 provides the least tension. The exerciser can adjust the tension member 54 by moving pin 60 to give the desired amount of tension. The exerciser can then tighten the knob 62 when the desired amount of tension is obtained.

As seen in FIGS. 1 and 2, the tensioning mechanism 57 also contains a cable 64 that is attached to the rectangular hollow backrest member 32 by a bracket 66. The cable 64 is threaded through pulley 68 and also threaded through pulley 70 and attached at 72 which is a portion of the channel member 15.

Semi-circular channel member 36 is captured in channel member 15 by three strips of flexible fiberglass as seen in FIG. 3. One flexible strip 21 is fastened to the inside portion of channel member 15 by fastening means 17. The other two flexible strips 23 and 25 are fastened by fastening means 19 to the outside of the semi-circular channel member 36. Fastening means 17 and 19 are screws, rivets or any suitable fastener. This provides capturing means in the channel member 15 for the semi-circular channel member 36.

Turning now to FIG. 2 there is seen a left side view of the present invention. In this view the knob 62 which is used to position the end of tension member 54 in the arcuate slot 58 can be seen. In the view the footrest 28, footrest bracket 24, footrest member 20, seat 12, backrest 30, and main hollow rectangular member 14 can also be seen. Also seen in this view is headrest 42, rectangular plate 43, rectangular member 44, hollow rectangular member 46, spring biased pin 48 and rectangular hollow backrest member 32. Also in this view is a spring biased pin 33 that holds the headrest member 46 in place when the headrest 42 is adjusted in the vertical position. FIG. 2 also shows the circular channel member 36, the tension member 54, the bracket 56 holding the tension member 54 to the inside of channel member 36 and brackets 34 and 38 holding the channel member 36 to the rectangular hollow backrest member 32. In this view the tension mechanism 57, held on to the inside of circular member 36 by bracket 52 has an arcuate slot 58 that pin 60 (not shown in FIG. 2) which holds one end of tension member 54 can slide. Pin 60 is threaded and knob 62 is used to tighten and hold the pin 60 in a fixed position in the arcuate slot 58. FIG. 2 also shows cable 64 which is threaded through pulleys 70, threaded through pulley 68 and attached to the rectangular hollow backrest member 32 by bracket 66. The cable 64 is also threaded through pulley 68 and pulley 70 and attached at 72 which is a portion of the channel member 15.

The operation of the exercise apparatus 10 is very easy. The exerciser after adjusting the equipment to fit the exerciser's torso pushes back with the leg muscles after placing both feet on footrest 28 causing the backrest 30 to rotate which in turn causes the semi-circular member 36 to rotate in channel 15. Simultaneously, a tension is placed in cable 64 that pulls the tensioning mechanism downward. This movement provides a tension in member 54 which gives a resistance to the exerciser. When the exerciser released the leg muscles, the semi-circular member 36 rotates back to the original position. The exerciser can repeat the above motion and exercise the four groups of muscles previously stated.

The present disclosure includes that contained in the appended claims, as well as that of the aforegoing description. Although this invention has been described in this preferred form, with a certain degree of particularity, it is understood that the present disclosure of the preferred form has been made by way of example and that numerous changes in the details of construction and the combination and arrangement of parts may be resorted to without departing from the spirit and scope of the invention.

What is claimed is:

1. An exercise apparatus for exercising, at least the calf muscles, the hamstring muscles, the quadriceps muscles and the maximus gluteus muscle comprising:

a seat, said seat having a top and a bottom, said top having a cushion attached thereon, said top being covered with a waterproof covering, said bottom of said seat fastened by said fastening means to a main flat rectangular hollow member, said main flat rectangular hollow member sitting on a hard surface;

said main flat rectangular hollow member having two rectangular stabilizing members attached at approximately a 45 degree angle to said main flat rectangular hollow member on one end and a footrest member on the other end;

said footrest member being rectangular and fitting inside said main flat rectangular hollow member, said footrest member being longitudinally adjustable by spring biased pins in the footrest member mating with holes in the main flat rectangular hollow member, said longitudinal adjustment used to conform to the length of a person's legs when exercising;

a tee shaped footrest pivotally mounted on the end of said rectangular footrest member, said tee shaped footrest having a stop that holds said tee shaped footrest in an approximate vertical position;

an exercise apparatus further comprising a rectangular backrest, said backrest having a hollow rectangular member attached on the back and in the center of said backrest, said backrest hollow rectangular member extending the entire length of said backrest, said backrest having a headrest attached to a hollow rectangular structure, said hollow rectangular structure being fitted inside said hollow rectangular member attached to said backrest, a headrest with a height being adjusted by moving said headrest either up or down in said hollow rectangular member attached to said backrest, said headrest height being adjusted by a knob attached to a screw, said screw being tightened by said knob, said screw bearing against said rectangular structure of said headrest to hold said headrest in the correct position, said headrest also being adjusted in the fore and aft position by a portion of said hollow rectangular structure of said headrest being attached forward of said backrest, a portion of said hollow rectangular structure having said headrest attached thereon, said headrest being adjustable fore and aft by spring biased pins mating in holes of said portion of said hollow rectangular structure, the adjustment of said headrest up or down and fore and aft being made to accommodate the diverse structure of persons using said exercise equipment;

an exercise apparatus wherein said hollow rectangular backrest member has attached thereto two hand hold members on each side of said hollow rectangular backrest member, said two hand hold members being perpendicular to said hollow rectangular backrest member, said two hand hold members providing stabilization to a person using said exercise equipment;

an exercise apparatus wherein said hollow rectangular backrest member has attached thereto a semi-circular channel member, said semi-circular channel member being captured in a flat channel member by capturing means, said flat channel member having adjusting means with said main flat hollow rectangular member, said main flat hollow rectangular member being fitted inside a portion of said flat channel member such that said adjustable means will allow the distance between said seat and said backrest to accommodate the diverse structure of persons using said exercise equipment;

an exercise apparatus wherein said capturing means is a fiberglass flexible strip divided into three segments whereby one end of said three segments is permanently attached to a bracket which is further attached to said flat rectangular channel member, while the other end is permanently attached to an outside surface of said semi-circular channel member, one end of the remaining two segments being permanently attached to the outer surface of said semi-circular channel member, while the other end of the remaining two segments are permanently attached to a surface of said flat channel member whereby when semi-circular channel member rotates in said flat channel member, said semi-circular channel member is always captured in said flat channel member, an exercise apparatus wherein said adjusting means of said main flat hollow rectangular member fitted in a portion of said flat channel member is adjusted to said flat channel member by a screw, said screw having a knob attached thereto whereby when said knob is turned, said screw will bear on said main flat hollow rectangular member and hold said flat channel member in place;

an exercise apparatus wherein said, hollow rectangular member attached to said backrest has a tension mechanism member pivotally attached thereto, said tension mechanism member end containing a return spring around a bolt in the pivoting end of said tensioning mechanism member, said tensioning mechanism member having attached thereto an arcuate groove having a top and a bottom, said arcuate groove having attached one end a tensioning means, the other end of said tensioning means being attached to the inside of said semicircular member, said tension mechanism member changing the tension in said tensioning means whereby the tension is the strongest when the end of said tensioning means is at said bottom of said arcuate groove and the tension is the weakest when the end of said tensioning means is at the top of said arcuate groove.

* * * * *